US009343277B2

(12) United States Patent
Campbell

(10) Patent No.: US 9,343,277 B2
(45) Date of Patent: May 17, 2016

(54) PARSING EVENTS DURING MS$^3$ EXPERIMENTS

(71) Applicant: DH TECHNOLOGIES DEVELOPMENT PTE. LTD., Singapore (SG)

(72) Inventor: John Lawrence Campbell, Milton (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/443,933

(22) PCT Filed: Nov. 21, 2013

(86) PCT No.: PCT/IB2013/002614
§ 371 (c)(1),
(2) Date: May 19, 2015

(87) PCT Pub. No.: WO2014/096917
PCT Pub. Date: Jun. 26, 2014

(65) Prior Publication Data

US 2015/0332904 A1 Nov. 19, 2015

Related U.S. Application Data

(60) Provisional application No. 61/739,849, filed on Dec. 20, 2012.

(51) Int. Cl.
*H01J 49/00* (2006.01)

(52) U.S. Cl.
CPC ..... *H01J 49/0031* (2013.01); *H01J 49/005* (2013.01)

(58) Field of Classification Search
CPC .... H01J 49/004; H01J 49/005; H01J 49/0031
See application file for complete search history.

(56) References Cited

U.S. PATENT DOCUMENTS 6,833,544 B1 * 12/2004 Campbell ..... H01J 49/4225 250/281
7,391,017 B2 6/2008 Kostrzewa et al.
(Continued)

FOREIGN PATENT DOCUMENTS

JP 2006-196216 A 7/2006
WO 99-01889 A1 1/1999

OTHER PUBLICATIONS

International Search Report and Written Opinion for PCT/IB2013/002614, mailed Apr. 22, 2014.

*Primary Examiner* — Wyatt Stoffa
(74) *Attorney, Agent, or Firm* — John R. Kasha; Kelly L. Kasha; Kasha Law LLC

(57) ABSTRACT

Systems and methods are provided for reducing the time period of a CID event of an MS$^3$ experiment and making the overall fragmentation event more generic. A CID event of an MS$^3$ experiment performed on a sample by a mass spectrometer is divided into two time periods using a processor. At the beginning of a first time period of the CID event, the mass spectrometer is instructed to both open a pulse valve in order to pulse a collision gas and apply a first CID voltage. At the beginning of a second time period of the CID event, the mass spectrometer is instructed to both close the pulse valve and apply a second CID voltage. The mass spectrometer is pumped down during the second time period. The overlap in time of the pump down and CID reduces the overall time period of the CID event.

18 Claims, 4 Drawing Sheets

(56) References Cited

U.S. PATENT DOCUMENTS 8,110,798 B2 * 2/2012 Collings ..... H01J 49/0481 250/282
8,237,109 B2 * 8/2012 Guna ..... H01J 49/005 250/281
8,309,914 B2 * 11/2012 Guna ..... H01J 49/426 250/281
8,698,072 B2 * 4/2014 Sugawara ..... H01J 49/0009 250/252.1
2004/0119015 A1 * 6/2004 Hashimoto ..... H01J 49/0481 250/292
2007/0187585 A1 8/2007 Verentchikov
2009/0194684 A1 * 8/2009 Guna ..... H01J 49/426 250/282
2010/0012835 A1 * 1/2010 Okumura ..... H01J 49/0045 250/288
2011/0192972 A1 * 8/2011 Furuhashi ..... H04J 49/0031 250/287
2013/0134306 A1 * 5/2013 Nakano ..... H01J 49/24 250/289
2013/0248704 A1 * 9/2013 Kenny ..... H01J 49/0031 250/283
2013/0285552 A1 * 10/2013 Duerr ..... H01J 27/026 315/111.91
2013/0334415 A1 * 12/2013 Sugawara ..... H01J 49/0009 250/288
2015/0235828 A1 * 8/2015 Campbell ..... H01J 49/4215 250/282
2015/0262799 A1 * 9/2015 Fujita ..... H01J 49/0031 250/288
2015/0279649 A1 * 10/2015 Yamaguchi ..... H01J 49/0009 250/287

* cited by examiner

100

PARSING EVENTS DURING $MS^3$ EXPERIMENTS

CROSS REFERENCE TO RELATED APPLICATION

This application claims the benefit of U.S. Provisional Patent Application Ser. No. 61/739,849, filed Dec. 20, 2012, the content of which is incorporated by reference herein in its entirety.

INTRODUCTION

Mass spectrometry/mass spectrometry/mass spectrometry ($MS^3$) is an increasing popular technique for quantitation experiments. Like mass spectrometry/mass spectrometry (MS/MS), which is commonly used in quantitation, $MS^3$ involves selecting a precursor ion for fragmentation and monitoring the fragmentation for a first generation fragment ion, or product ion. However, $MS^3$ includes the additional step of fragmenting the product ion and monitoring that fragmentation for one or more second generation fragment ions. This additional step gives $MS^3$ experiments greater specificity and greater resilience to chemical noise in comparison to MS/MS experiments.

However, $MS^3$ experiments, in general, have cycle times that are much longer than traditional MS/MS experiments. In particular, two problems have emerged that affect the cycle times of full-scan $MS^3$ experiments performed on ion trap mass spectrometers.

First, the time it takes for handling collision gas in an ion trap mass spectrometer cannot be significantly reduced. In general, an ion trap mass spectrometer uses collision-induced dissociation (CID) for the fragmentation events in $MS^3$ experiments. Conventionally, a CID event involves the simultaneous application of a CID voltage and a pulse of collision gas. Because the pulse of collision gas normally requires a "pump down" period to get rid of excess collision gas and avoid over pressuring the system, the time period of a CID must include this "pump down" period. In addition the time period during which a CID voltage is applied cannot be reduced without the reduction resulting in diminished fragmentation efficiency.

Second, workflow tools do not exist to optimize the final fragmentation stage of $MS^3$ experiments. Conventional tools exist to predict the primary fragment ions for MS/MS quantitation. Similar tools, however, are not available to help select the best second-generation fragment ions for $MS^3$ quantitation.

SUMMARY

A system is disclosed for reducing the time period of a collision-induced dissociation (CID) event of a mass spectrometry/mass spectrometry/mass spectrometry ($MS^3$) experiment and to yield a more overall generic CID event during the $MS^3$ experiment. The system includes a mass spectrometer and a processor.

The mass spectrometer performs an $MS^3$ experiment on a sample. The processor divides a CID event of the $MS^3$ experiment into two time periods. At the beginning of a first time period of the CID event, processor instructs the mass spectrometer to both open a pulse valve in order to pulse a collision gas and apply a first CID voltage. At the beginning of a second time period of the CID event, the processor instructs the mass spectrometer to both close the pulse valve and apply a second CID voltage. During the second time period of the CID event, the initial pulse of gas is pumped away from the mass spectrometer, restoring the original baseline pressure. However, this pump down takes a short period of time, during which the residual gas can be used in a second CID event. This allows pump down and CID to overlap in time, thereby reducing the overall time period of the CID event. In addition, the second CID voltage can be different from the first CID voltage, thereby subjecting the target ions to different fragmentation regimes, making the overall fragmentation events more generic.

A method is disclosed for reducing the time period of a CID event of an $MS^3$ experiment and to yield a more overall generic CID event during the $MS^3$ experiment. A CID event of an $MS^3$ experiment performed on a sample by a mass spectrometer is divided into two time periods using a processor. At the beginning of a first time period of the CID event, the mass spectrometer is instructed to both open a pulse valve in order to pulse a collision gas and apply a first CID voltage using the processor. At the beginning of a second time period of the CID event, the mass spectrometer is instructed to both close the pulse valve and apply a second CID voltage using the processor.

A computer program product is disclosed that includes a non-transitory and tangible computer-readable storage medium whose contents include a program with instructions being executed on a processor so as to perform a method for reducing the time period of a CID event of an $MS^3$ experiment and to yield a more overall generic CID event during the $MS^3$ experiment. In various embodiments, the method includes providing a system, wherein the system comprises one or more distinct software modules, and wherein the distinct software modules comprise an analysis module and a control module.

The analysis module divides a CID event of an $MS^3$ experiment performed on a sample by a mass spectrometer into two time periods. At the beginning of a first time period of the CID event, the control module instructs the mass spectrometer to both open a pulse valve in order to pulse a collision gas and apply a first CID voltage. At the beginning of a second time period of the CID event, the control module instructs the mass spectrometer to both close the pulse valve and apply a second CID voltage.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
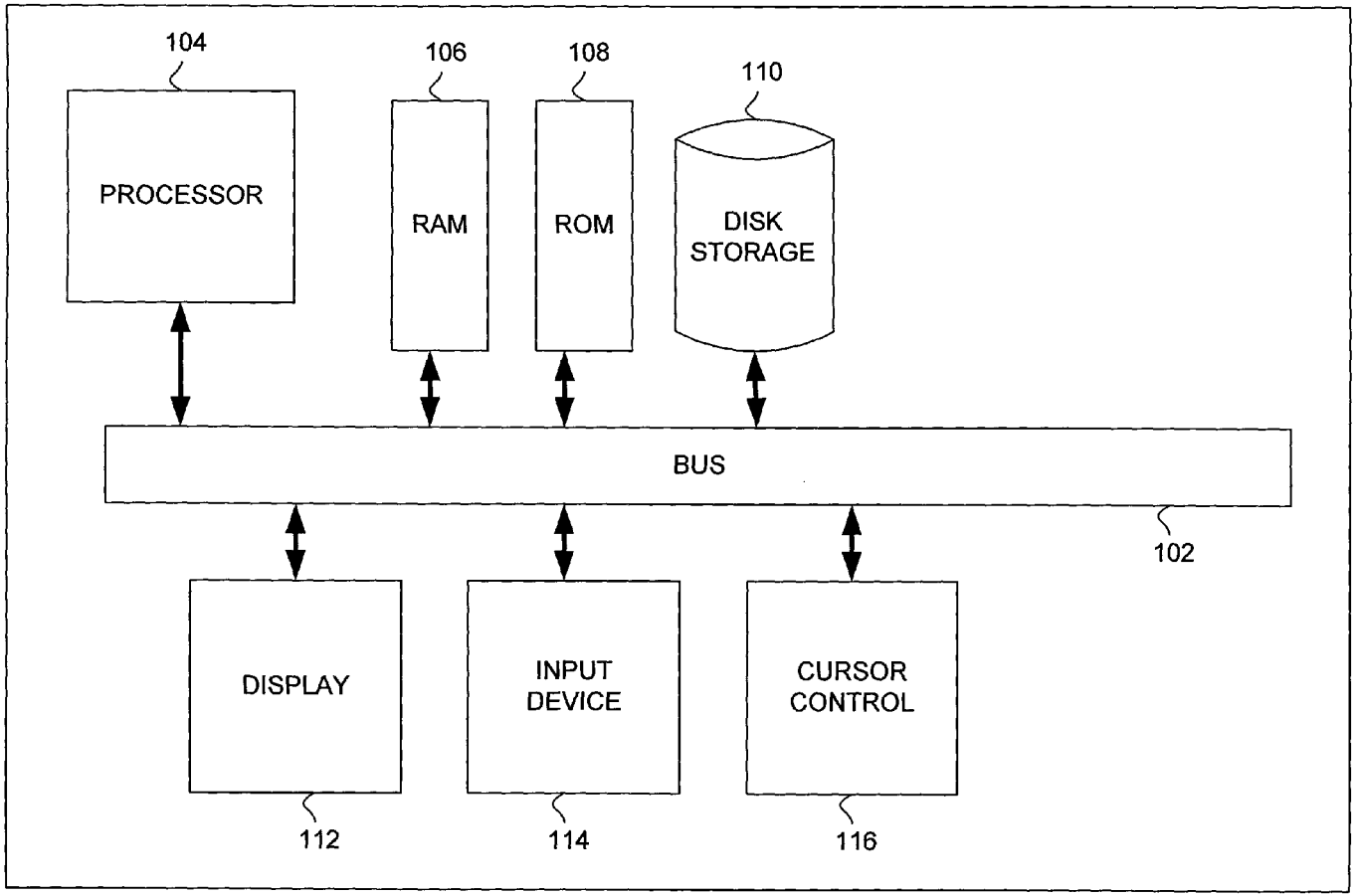
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Segmenting a CID Event

As described above, mass spectrometry/mass spectrometry/mass spectrometry ($MS^3$) experiments provide greater specificity and greater resilience to chemical noise as compared to mass spectrometry/mass spectrometry (MS/MS) experiments. However, $MS^3$ experiments, in general, have cycle times that are much longer than traditional mass spectrometry/mass spectrometry (MS/MS) experiments. One problem that affects the throughput of $MS^3$ experiments performed on ion trap spectrometers is the difficulty in reducing the time it takes to handle the collision gas during a collision-induced dissociation (CID) event.

In various embodiments, in order to avoid over pressuring an ion trap mass spectrometer without sacrificing fragmentation efficiency, each collision gas pulse and fragmentation event, or CID event, is separated. In such an $MS^3$ experiment, both the collision gas pulse and fragmentation excitation begin at the same time. However, the collision gas pulse ends before the excitation event ends.

This means that the ions continue to be excited and fragmented after the collision gas pulse valve has closed. These ions continue to be excited and fragmented by the residual pulse collision gas still in the ion trap mass spectrometer.

Therefore, the end of the excitation event coincides or overlaps with the initial "pump down" period of the ion trap mass spectrometer. This overlap of the pump down period with continued excitation reduces the overall time of the entire CID event.

For example, in a traditional $MS^3$ experiment the collision gas pulse valve is open during the entire fragmentation period. As the time between CID events is decreased in $MS^3$ experiments, a greater percentage of the duty cycle involves a collision pulse valve "open" state. This results in higher pressures within the ion trap mass spectrometer and requires greater time for pump down to baseline operating pressures.

Through experimentation, it was determined that a small amount of collision gas remains in an ion trap even after the collision gas pulse valve is closed. As a result, it was determined that if the total CID event time period was split in two, the collision gas pulse valve could be opened for part of the total CID event time period and closed for part of the total CID event time period without halting the excitation or fragmentation of the ions in the ion trap. For example, if the collision gas pulse valve was opened for 75% of the total CID event time period and closed for 25% of the total CID event time period, excitation or fragmentation of the ions in the ion trap continued throughout the 25% of the total CID event time period.

Also as described above, workflow tools do not exist to optimize the final fragmentation stage, of $MS^3$ experiments. Conventional tools exist to predict the primary fragment ions for MS/MS quantitation. Similar tools, however, are not available to help select the best second-generation fragment ions for $MS^3$ quantitation.

In various embodiments, the secondary fragmentation stage of a quantitation workflow for an $MS^3$ experiments can be improved in two ways. First, since many ions fragment optimally at CID voltages between 0.1 V and 0.25 V, for example, the parsed CID events, described above, can use increasing values of CID voltage during each stage. For example, a first stage of a CID event can have a CID voltage of 0.1 V and a second stage of the CID event can have a CID voltage of 0.25 V. This creates an overall stepped $MS^3$ collision energy.

Second, the best $MS^3$ second-generation fragment ions for use in quantitation are selected post-acquisition when the fragmentation behavior of the targeted analyte ion is unknown. For example, the $MS^3$ collision energy is applied to the first generation fragments produced from MS/MS. Post-acquisition, the most intense and lowest noise $MS^3$ channels are selected for use in quantitative analyses. Since the CID fragmentation pattern of a given ion can be simple to predict post hoc, the list of potential $MS^3$ channels is quite small and can easily be verified.

System for Segmenting a CID Event

Figure 2:
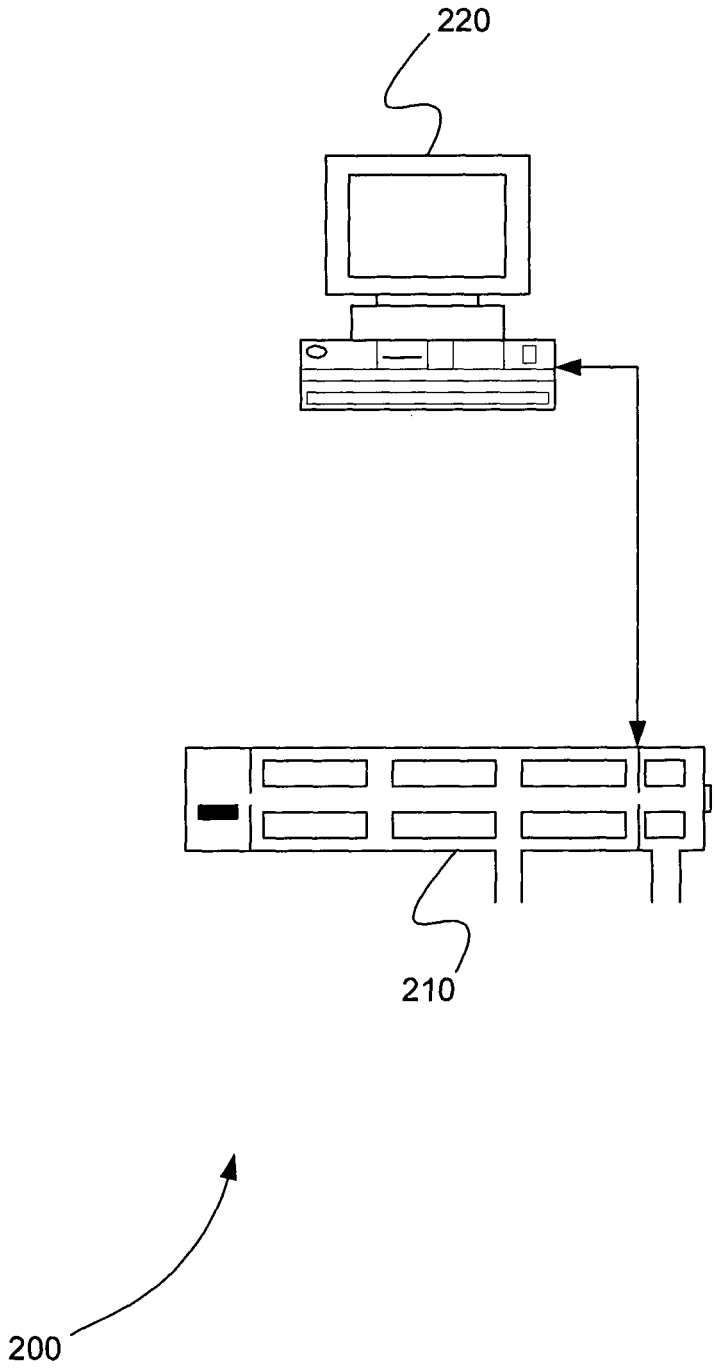
FIG. 2 is a schematic diagram showing a system for reducing the time period of a collision-induced dissociation (CID) event of a mass spectrometry/mass spectrometry/mass spectrometry ($MS^3$) experiment, in accordance with various embodiments.

FIG. 2 is a schematic diagram showing a system 200 for reducing the time period of a collision-induced dissociation (CID) event of a mass spectrometry/mass spectrometry/mass spectrometry ($MS^3$) experiment, in accordance with various embodiments. System 200 includes mass spectrometer 210 and processor 220.

Mass spectrometer 210 can include one or more physical mass analyzers that perform one or more mass analyses. A mass analyzer of mass spectrometer 210 can include, but is not limited to, a quadrupole, an ion trap, a linear ion trap, an orbitrap, or any mass analyzer or combination of mass analyzers capable of performing CID. Mass spectrometer 210 can also include a one or more separation devices (not shown). The separation device can perform a separation technique that includes, but is not limited to, liquid chromatography, gas chromatography, capillary electrophoresis, or ion mobility. Mass spectrometer 210 can include separating mass spectrometry stages or steps in space or time, respectively.

Processor 220 can be, but is not limited to, a computer, microprocessor, or any device capable of sending and receiving control signals and data to and from mass spectrometer 210 and processing data. Processor 220 is in communication with mass spectrometer 210.

Mass spectrometer 210 performs an $MS^3$ experiment on a sample. Processor 220 divides a CID event of the $MS^3$ experiment into two time periods. At the beginning of a first time period of the CID event, processor 200 instructs mass spectrometer 210 to both open a pulse valve in order to pulse a collision gas and apply a first CID voltage. At the beginning of a second time period of the CID event, processor 220 instructs mass spectrometer 210 to both close the pulse valve and apply a second CID voltage. Mass spectrometer 210 is pumped down during the second time period of the CID event. This allows the pump down and CID to overlap in time, thereby reducing the overall time period of the CID event.

In various embodiments, the first CID voltage and the second CID voltage are the same CID voltage. In various alternative embodiments, the first CID voltage and the second CID voltage are different CID voltages.

In various embodiments, if the first CID voltage and the second CID voltage are different CID voltages, the difference in voltage between the first CID voltage and the second CID voltage causes a step in collision energy across the CID event.

In various embodiments, the first time period and the second time period have different lengths. For example, the first time period is longer than the second time period.

In various embodiments, processor 220 further receives a plurality of second generation fragmentation spectra from the $MS^3$ experiment. Processor 220 selects second generation fragment ions from the plurality of second generation fragmentation spectra that have an intensity above a threshold intensity level and a signal-to-noise ratio (S/N) above a threshold S/N level for quantitation. In various embodiments, Processor 220 selects second generation fragment ions from the plurality of second generation fragmentation spectra that have an intensity above a threshold intensity level and a signal-to-noise ratio (S/N) above a threshold S/N level to identify a compound.

Method for Segmenting a CID event

Figure 3:
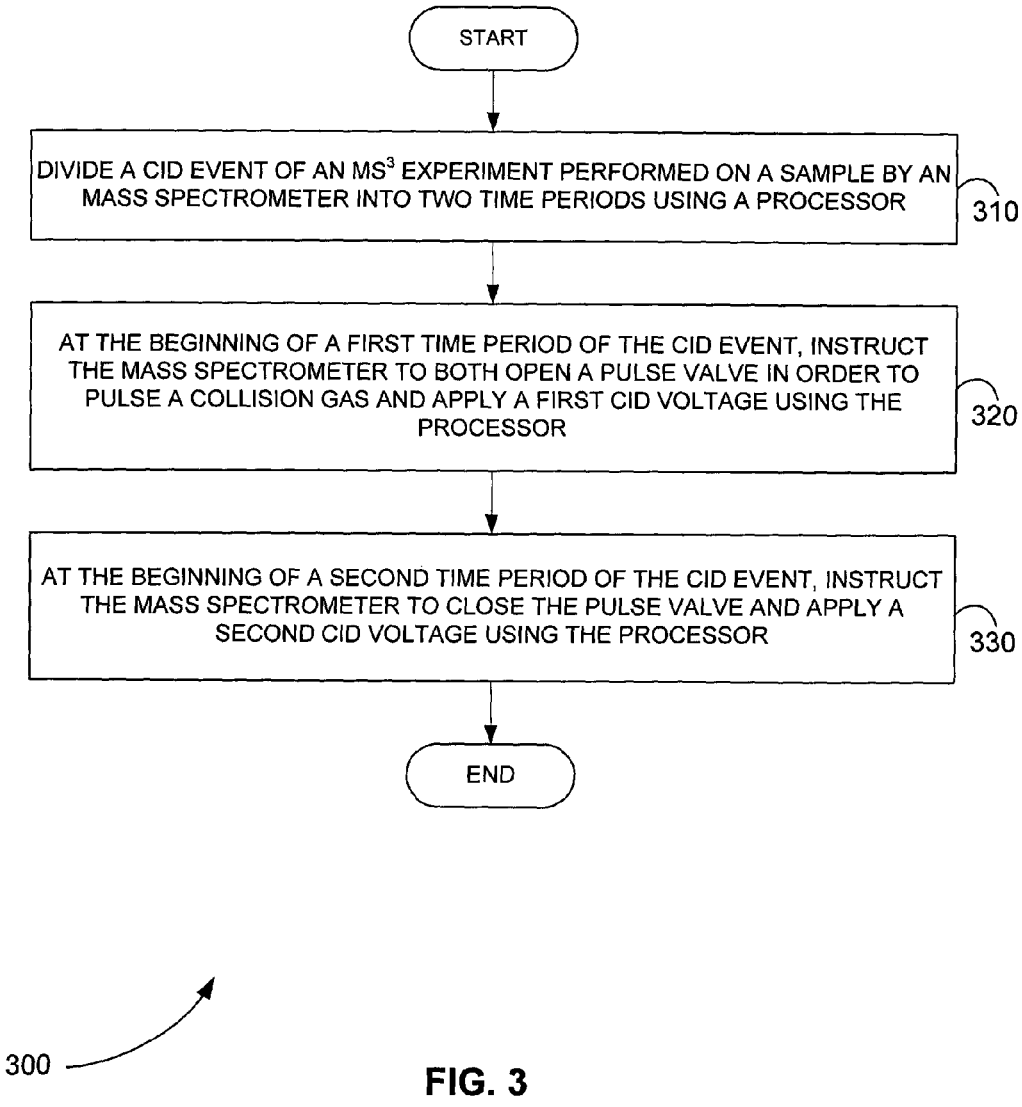
FIG. 3 is an exemplary flowchart showing a method for reducing the time period of a CID event of an $MS^3$ experiment, in accordance with various embodiments.

FIG. 3 is an exemplary flowchart showing a method 300 for reducing the time period of a CID event of an $MS^3$ experiment, in accordance with various embodiments.

In step 310 of method 300, a CID event of an $MS^3$ experiment performed on a sample by a mass spectrometer is divided into two time periods using a processor.

In step 320, at the beginning of a first time period of the CID event, the mass spectrometer is instructed to both open a pulse valve in order to pulse a collision gas and apply a first CID voltage using the processor.

In step 330, at the beginning of a second time period of the CID event, the mass spectrometer is instructed to both close the pulse valve and apply a second CID voltage using the processor. The mass spectrometer is pumped down during the second time period. The overlap in time of the pump down and CID reduces the overall time period of the CID event.

Computer Program Product for Segmenting a CID event

In various embodiments, computer program products include a tangible computer-readable storage medium whose contents include a program with instructions being executed on a processor so as to perform a method for reducing the time period of a CID event of an $MS^3$ experiment. This method is performed by a system that includes one or more distinct software modules.

Figure 4:
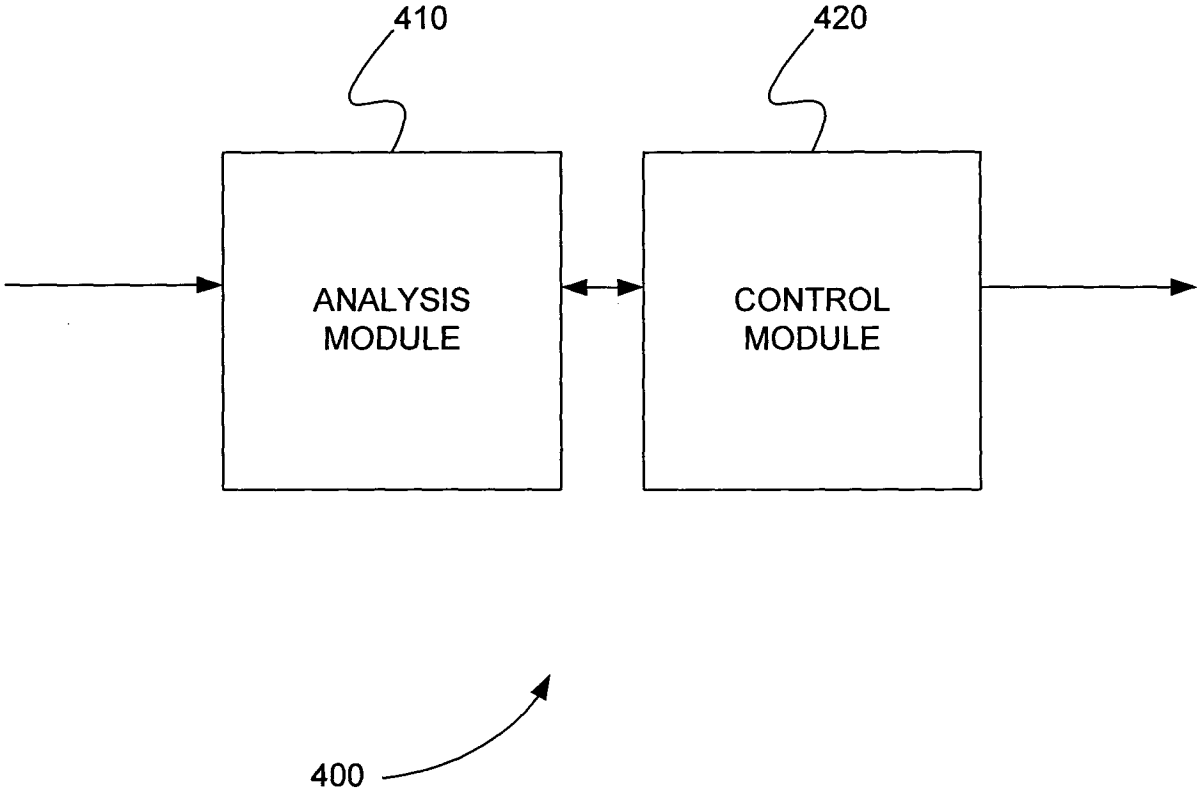
FIG. 4 is a schematic diagram of a system that includes one or more distinct software modules that performs a method for reducing the time period of a CID event of an $MS^3$ experiment, in accordance with various embodiments.

FIG. 4 is a schematic diagram of a system 400 that includes one or more distinct software modules that performs a method for reducing the time period of a CID event of an $MS^3$ experiment, in accordance with various embodiments. System 400 includes analysis module 410 and control module 420.

Analysis module 410 divides a CID event of an $MS^3$ experiment performed on a sample by a mass spectrometer into two time periods. At the beginning of a first time period of the CID event, control module 420 instructs the mass spectrometer to both open a pulse valve in order to pulse a collision gas and apply a first CID voltage. At the beginning of a second time period of the CID event, control module 420 instructs the mass spectrometer to both close the pulse valve and apply a second CID voltage. The mass spectrometer is pumped down during the second time period. The overlap in time of the pump down and CID reduces the overall time period of the CID event.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for segmenting a collision-induced dissociation (CID) event of a mass spectrometry/mass spectrometry/mass spectrometry ($MS^3$) experiment, comprising:

a mass spectrometer that performs an $MS^3$ experiment on a sample;

a processor in communication with the mass spectrometer that divides a CID event of the $MS^3$ experiment into two time periods, at the beginning of a first time period of the CID event, instructs the mass spectrometer to both open a pulse valve in order to pulse a collision gas and apply a first CID voltage, and at the beginning of a second time period of the CID event, instructs the mass spectrometer to both close the pulse valve and apply a second CID voltage, wherein the mass spectrometer is pumped down during the second time period allowing pump down and CID to overlap in time, receives a plurality of second generation fragmentation spectra from the $MS^3$ experiment, and selects second generation fragment ions from the plurality of second generation fragmentation spectra that have an intensity above a threshold intensity level and a signal-to-noise ratio (S/N) above a threshold S/N level for quantitation.

2. The system of claim 1, wherein the first CID voltage and the second CID voltage are the same CID voltage.

3. The system of claim 1, wherein the first CID voltage and the second CID voltage are different CID voltages.

4. The system of claim 1, wherein the first CID voltage and the second CID voltage are different CID voltages and the difference in voltage between the first CID voltage and the second CID voltage causes a step in collision energy across the CID event.

5. The system of claim 1, wherein the first time period and the second time period have different lengths.

6. The system of claim 1, wherein the first time period is longer than the second time period.

7. A method for segmenting a collision-induced dissociation (CID) event of a mass spectrometry/mass spectrometry/mass spectrometry ($MS^3$) experiment, comprising:

dividing a CID event of an $MS^3$ experiment performed on a sample by a mass spectrometer into two time periods using a processor;

at the beginning of a first time period of the CID event, instructing the mass spectrometer to both open a pulse valve in order to pulse a collision gas and apply a first CID voltage using the processor;

at the beginning of a second time period of the CID event, instructing the mass spectrometer to both close the pulse valve and apply a second CID voltage using the processor wherein the mass spectrometer is pumped down during the second time period allowing pump down and CID to overlap in time thereby;

receiving a plurality of second generation fragmentation spectra from the $MS^3$ experiment using the processor; and selecting second generation fragment ions from the plurality of second generation fragmentation spectra that have an intensity above a threshold intensity level and a signal-to-noise ratio (S/N) above a threshold S/N level for quantitation using the processor.

8. The method of claim 7, wherein the first CID voltage and the second CID voltage are the same CID voltage.

9. The method of claim 7, wherein the first CID voltage and the second CID voltage are different CID voltages.

10. The method of claim 7, wherein the first CID voltage and the second CID voltage are different CID voltages and the difference in voltage between the first CID voltage and the second CID voltage causes a step in collision energy across the CID event.

11. The method of claim 7, wherein the first time period and the second time period have different lengths.

12. The method of claim 7, wherein the first time period is longer than the second time period.

13. A computer program product, comprising a non-transitory and tangible computer-readable storage medium whose contents include a program with instructions being executed on a processor so as to perform a method for segmenting a collision-induced dissociation (CID) event of a mass spectrometry/mass spectrometry/mass spectrometry ($MS^3$) experiment, the method comprising:

providing a system, wherein the system comprises one or more distinct software modules, and wherein the distinct software modules comprise an analysis module and a control module;

dividing a CID event of an $MS^3$ experiment performed on a sample by a mass spectrometer into two time periods using the analysis module;

at the beginning of a first time period of the CID event, instructing the mass spectrometer to both open a pulse valve in order to pulse a collision gas and apply a first CID voltage using the control module;

at the beginning of a second time period of the CID event, instructing the mass spectrometer to both close the pulse valve and apply a second CID voltage using the control module; wherein the mass spectrometer is pumped down during the second time period allowing pump down and CID to overlap in time;

receiving a plurality of second generation fragmentation spectra from the $MS^3$ experiment using the analysis module; and selecting second generation fragment ions from the plurality of second generation fragmentation spectra that have an intensity above a threshold intensity level and a signal-to-noise ratio (S/N) above a threshold S/N level for quantitation using the analysis module.

14. The computer program product of claim 13, wherein the first CID voltage and the second CID voltage are the same CID voltage.

15. The computer program product of claim 13, wherein the first CID voltage and the second CID voltage are different CID voltages.

16. The computer program product of claim 13, wherein the first CID voltage and the second CID voltage are different CID voltages and the difference in voltage between the first CID voltage and the second CID voltage causes a step in collision energy across the CID event.

17. The computer program product of claim 13, wherein the first time period and the second time period have different lengths.

18. The computer program product of claim 13, wherein the first time period is longer than the second time period.

* * * * *